US010760747B2

(12) United States Patent
Kim et al.

(10) Patent No.: US 10,760,747 B2
(45) Date of Patent: Sep. 1, 2020

(54) LIGHTING APPARATUS

(71) Applicant: JUSUNG ENGINEERING CO., LTD., Gwangju-si, Gyeonggi-do (KR)

(72) Inventors: Jung Bae Kim, Gwangju-si (KR); Young Tae Yoon, Gwangju-si (KR); Kyung Guk Lee, Gwangju-si (KR)

(73) Assignee: JUSUNG ENGINEERING CO., LTD. (KR)

( * ) Notice: Subject to any disclaimer, the term of this patent is extended or adjusted under 35 U.S.C. 154(b) by 314 days.

(21) Appl. No.: 15/753,169

(22) PCT Filed: Aug. 9, 2016

(86) PCT No.: PCT/KR2016/008725
§ 371 (c)(1),
(2) Date: Feb. 15, 2018

(87) PCT Pub. No.: WO2017/026767
PCT Pub. Date: Feb. 16, 2017

(65) Prior Publication Data

US 2018/0363864 A1 Dec. 20, 2018

(30) Foreign Application Priority Data

Aug. 13, 2015 (KR) ..... 10-2015-0114795

(51) Int. Cl.
*H01R 31/00* (2006.01)
*F21S 2/00* (2016.01)
(Continued)

(52) U.S. Cl.
CPC ..... *F21S 2/005* (2013.01); *F21V 19/001* (2013.01); *F21V 23/001* (2013.01); *F21V 23/06* (2013.01);
(Continued)

(58) Field of Classification Search
None
See application file for complete search history.

(56) References Cited

U.S. PATENT DOCUMENTS

2006/0044237 A1* 3/2006 Lee ..... G09G 3/3233 345/82
2007/0153508 A1* 7/2007 Nall ..... F21S 4/10 362/219
(Continued)

FOREIGN PATENT DOCUMENTS

CN 102646372 A 8/2012
CN 203823501 U 9/2014
(Continued)

*Primary Examiner* — Andrew J Coughlin
(74) *Attorney, Agent, or Firm* — Renaissane IP Law Group LLP

(57) ABSTRACT

The present invention provides a lighting apparatus which is easy in expandability of a plurality of lighting panels. The lighting apparatus according to the present invention may include: a plurality of lighting panels including an emission part having a light emitting device which emits light with a current flowing between a first electrode and a second electrode; and a panel connection means disposed between the plurality of lighting panels to electrically connect first and second electrodes between adjacent lighting panels. Each of the plurality of lighting panels may include first and second auxiliary wirings electrically connected between adjacent panel connection means.

14 Claims, 7 Drawing Sheets

(51) Int. Cl.

| | |
|---|---|
| ***F21V 23/00*** | (2015.01) |
| ***F21V 19/00*** | (2006.01) |
| ***F21V 23/06*** | (2006.01) |
| *F21V 21/005* | (2006.01) |
| *F21Y 115/15* | (2016.01) |

(52) U.S. Cl.
CPC ..... *F21V 21/005* (2013.01); *F21Y 2115/15* (2016.08)

(56) References Cited

U.S. PATENT DOCUMENTS

| | | | | |
|---|---|---|---|---|
| 2008/0087903 | A1* | 4/2008 | Stoyan | F21S 2/005 257/88 |
| 2009/0040758 | A1 | 2/2009 | Tu et al. | |
| 2013/0196078 | A1 | 8/2013 | Yudovsky et al. | |
| 2014/0239823 | A1 | 8/2014 | Ahn | |
| 2015/0049485 | A1* | 2/2015 | Kamitani | H01R 31/06 362/249.01 |
| 2016/0109102 | A1* | 4/2016 | Kim | F21V 23/005 362/249.03 |

FOREIGN PATENT DOCUMENTS

| | | | |
|---|---|---|---|
| JP | 2014225442 | A | 12/2014 |
| JP | 2015011882 | A | 1/2015 |
| KR | 20070103319 | A | 10/2007 |
| KR | 20120032509 | A | 4/2012 |
| KR | 20140106205 | A | 9/2014 |

* cited by examiner

LIGHTING APPARATUS

TECHNICAL FIELD

The present invention relates to a lighting apparatus, and more particularly, to a lighting apparatus including a plurality of lighting panel.

BACKGROUND ART

Generally, bulbs or fluorescent lamps are being much used as indoor or outdoor lightings, but since the bulbs or the fluorescent lamps are very short in lifetime, the bulbs or the fluorescent lamps should be frequently replaced. In order to solve such a problem, a lighting apparatus using a light emitting diode (LED) has been developed. Particularly, since an LED lighting apparatus has good controllability, a fast response time, high electro-optical conversion efficiency, long lifetime, and low power consumption, development and research on the lighting apparatus using the LED are being more actively done.

Recently, a lighting apparatus where a plurality of LED modules are assembled in series or parallel is being developed. Particularly, an organic light emitting diode (OLED) lighting panel using an organic light emitting device instead of an LED module is being developed, and moreover, a lighting apparatus where a plurality of OLED lighting panels are assembled in series or parallel is being researched and developed.

FIG. 1 is a diagram for describing a related art lighting apparatus.

Referring to FIG. 1, the related art lighting apparatus may include first to nth lighting panels 10-1 to **10-*n* connected to each other electrically and serially, a power supply member 20, and a power cable 30**.

Each of the first to nth lighting panels 10-1 to **10-*n* may be a flat light source including an LED module or an organic light emitting device. A first power terminal is provided in one end of each of the first to nth lighting panels 10-1 to 10-*n*, and a second power terminal is provided in the other end of each of the first to nth lighting panels 10-1 to 10-*n***. Here, the first power terminal may be a first lighting power source (for example, a positive terminal (+)), and the second power terminal may be a second lighting power source (for example, a negative terminal (−)).

The power supply member 20 is connected to the first power terminal of the first lighting panel 10-1 and the power cable 30 and supplies a lighting power, supplied from the outside, to the first lighting panel 10-1.

The power cable 30 electrically connects the second power terminal of the nth lighting panel **10-*n* to the power supply member 20**.

The related art lighting apparatus drives the first to nth lighting panels 10-1 to **10-*n*** with the lighting power to illuminate the inside or the outside.

However, in the related art lighting apparatus, due to an internal resistance of each of the first to nth lighting panels 10-1 to **10-*n*, brightness is reduced in a direction from the first lighting panel 10-1 to the nth lighting panel 10-*n*, and for this reason, there is a problem where brightness of each of the first to nth lighting panels 10-1 to 10-*n* is non-uniform. Also, in the related art lighting apparatus, since a separate power cable 30 for electrically and serially connecting the first to nth lighting panels 10-1 to 10-*n* is needed, expandability is reduced due to a length of the power cable 30**.

Information disclosed in this Background section was already known to the inventors of the present invention before achieving the present invention or is technical information acquired in the process of achieving the present invention. Therefore, it may contain information that does not form the prior art that is already known in this country to a person of ordinary skill in the art.

DISCLOSURE

Technical Problem

Therefore, the present invention has been made in view of the above problems, and it is an object of the present invention to provide a lighting apparatus which is easy in expandability of a plurality of lighting panels.

Also, it is another object of the present invention to provide a lighting apparatus in which a plurality of lighting panels are easily connected to each other in series or parallel.

Technical Solution

To accomplish the above-described objects, a lighting apparatus according to the present invention may include: a plurality of lighting panels including an emission part having a light emitting device which emits light with a current flowing between a first electrode and a second electrode; and a panel connection means disposed between the plurality of lighting panels to electrically connect first and second electrodes between adjacent lighting panels, wherein each of the plurality of lighting panels may include first and second auxiliary wirings electrically connected between adjacent panel connection means.

The panel connection means may electrically and serially connect the first and second electrodes between the adjacent lighting panels.

Each of the plurality of lighting panels may be simultaneously supplied with a lighting power through each of two adjacent panel connection means.

To accomplish the above-described objects, a lighting apparatus according to the present invention may include one or more lighting panels including an emission part provided on a substrate, wherein the lighting panel may include one or more auxiliary wirings formed on the substrate to supply power to the emission part.

To accomplish the above-described objects, a lighting apparatus according to the present invention may include a plurality of lighting panels, wherein each of the plurality of lighting panels may include: an emission part including a light emitting device which emits light with a current flowing in a primary electrode; and a secondary electrode electrically connected to the primary electrode.

To accomplish the above-described objects, a lighting apparatus according to the present invention may include: a lighting panel including an emission part; a first wiring provided in the lighting panel to supply power to the emission part; and a second wiring provided in the lighting panel to divert the power without supplying the power to the emission part.

Advantageous Effect

According to the technical solution, the present invention electrically connects a plurality of lighting panels through a panel connection means in series or parallel, thereby facilitating the serial or parallel connection and expandability of the plurality of lighting panels.

Moreover, the present invention transfers a lighting power to a next-end lighting panel through a separate auxiliary wiring provided in each of the lighting panels when connecting the plurality of lighting panels through the panel connection means in parallel, and thus, can minimize the voltage drop of the lighting power supplied to each lighting panel, thereby increasing the emission uniformity of each lighting panel.

In addition to the aforesaid objects of the present invention, other features and advantages of the present invention will be described below, but will be clearly understood by those skilled in the art from descriptions below.

MODE FOR INVENTION

Figure 1:
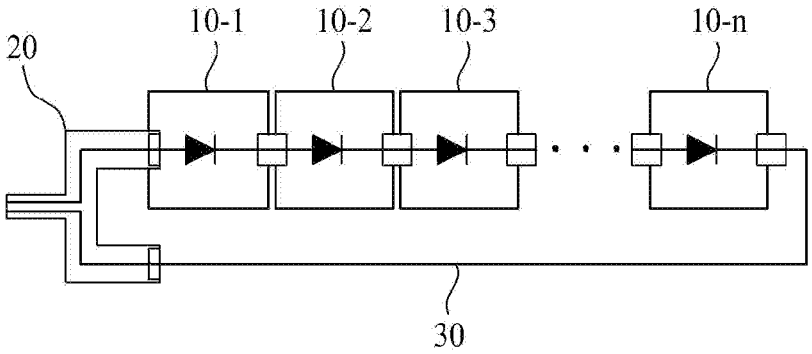
FIG. 1 is a diagram for describing a related art lighting apparatus.

The terms described in the specification should be understood as follows.

The terms described in the specification should be understood as follows. As used herein, the singular forms "a", "an" and "the" are intended to include the plural forms as well, unless the context clearly indicates otherwise. The terms "first" and "second" are for differentiating one element from the other element, and these elements should not be limited by these terms. It will be further understood that the terms "comprises", "comprising,", "has", "having", "includes" and/or "including", when used herein, specify the presence of stated features, integers, steps, operations, elements, and/or components, but do not preclude the presence or addition of one or more other features, integers, steps, operations, elements, components, and/or groups thereof. The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item. The term "on" should be construed as including a case where one element is formed at a top of another element and moreover a case where a third element is disposed therebetween.

Hereinafter, exemplary embodiments of a light guide plate, and a backlight unit and a mobile device including the same according to the present invention will be described in detail with reference to the accompanying drawings. In the specification, in adding reference numerals for elements in each drawing, it should be noted that like reference numerals already used to denote like elements in other drawings are used for elements wherever possible. In the following description, when the detailed description of the relevant known function or configuration is determined to unnecessarily obscure the important point of the present invention, the detailed description will be omitted.

Figure 2:
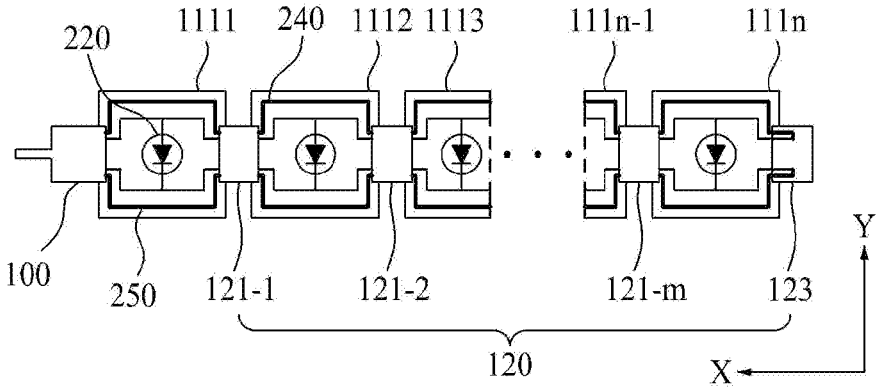
FIG. 2 is a diagram for describing a lighting apparatus according to the present invention.

FIG. 2 is a diagram for describing a lighting apparatus according to the present invention.

Referring to FIG. 2, the lighting apparatus according to the present invention includes a plurality of lighting panels 1111 to 111*n* and a panel connection means 120.

A power supply means 100 is electrically connected to a first lighting panel 1111 of the plurality of lighting panels 1111 to 111*n*, and the first lighting panel 1111 is supplied with a lighting power from the power supply means 100. Each of the plurality of lighting panels 1111 to 111*n* may have a square shape, but may have a polygonal shape including a rectangular shape or a polygonal shape including a curved surface without being limited thereto.

Each of the plurality of lighting panels 1111 to 111*n* includes an emission part 220 including a light emitting device that emits light with a current flowing between a first electrode (for a first primary electrode) and a second electrode (or a second primary electrode). Here, the light emitting device of the emission part 220 is a current driving type semiconductor device and may be an LED or an organic light emitting device.

The emission part 220 according to an embodiment may include a plurality of LEDs which are connected in series and/or parallel between the first and second electrodes.

The emission part 220 according to another embodiment may include the first electrode, the second electrode, and an organic light emitting device including an organic layer provided between the first electrode and the second electrode.

Each of the plurality of lighting panels 1111 to 111*n* includes first and second auxiliary wirings 240 and 250 for supplying power to the emission part 220.

Each of the first and second auxiliary wirings 240 and 250 supplies the power to the emission part 220 through the panel connection means 120 adjacent thereto.

The panel connection means 120 is disposed between the plurality of lighting panels 1111 to 111*n* and electrically connects the emission part 220 to the auxiliary wirings 240 and 250. That is, the panel connection means 120 is disposed between the plurality of lighting panels 1111 to 111*n* and electrically connects the first and second electrodes between adjacent lighting panels. The panel connection means 120 according to an embodiment may include a plurality of middle connection members 121-1 to 121-*m* and an end connection member 123.

Each of the plurality of middle connection members 121-1 to 121-*m* may be disposed between a pair of lighting panels 1111 to 111*n* which are adjacent to each other in a lengthwise direction X of the lighting apparatus, and may electrically connect first and second electrodes between the pair of lighting panels 1111 to 111*n* adjacent to each other. That is, the middle connection members 121-1 to 121-*m* may electrically and serially or parallelly connect first and second electrodes, provided in some lighting panels 1111 to 111*n* adjacent to one side thereof, to first and second electrodes provided in other lighting panels 1111 to 111*n* adjacent to the other side thereof.

The end connection member 123 may connect the first auxiliary wiring 240 to a first electrode provided in a last lighting panel 111*n* and may connect the second auxiliary wiring 250 to a second electrode provided in the last lighting panel 111*n*.

The panel connection means 120 may electrically connect first and second electrodes between adjacent lighting panels in series or parallel, and thus, may allow the plurality of lighting panels 1111 to 111*n* to be electrically driven in series or parallel according to the lighting power supplied through the power supply means 100.

In the lighting apparatus according to the present invention, since adjacent lighting panels 1111 to 111*n* may be electrically connected to each other through the panel connection means 120 in series or parallel, a serial or parallel connection between the plurality of lighting panels 1111 to 111*n* is easy, and expandability is easy.

The lighting panels 1112 to 111*n* other than a first lighting panel 1111 of the plurality of lighting panels 1111 to 111*n* may be additional lighting panels. Here, the lighting panel 1111 and the additional lighting panels 1112 to 111*n* may be electrically connected to each other through the panel connection means 120 in series or parallel.

Figure 3:
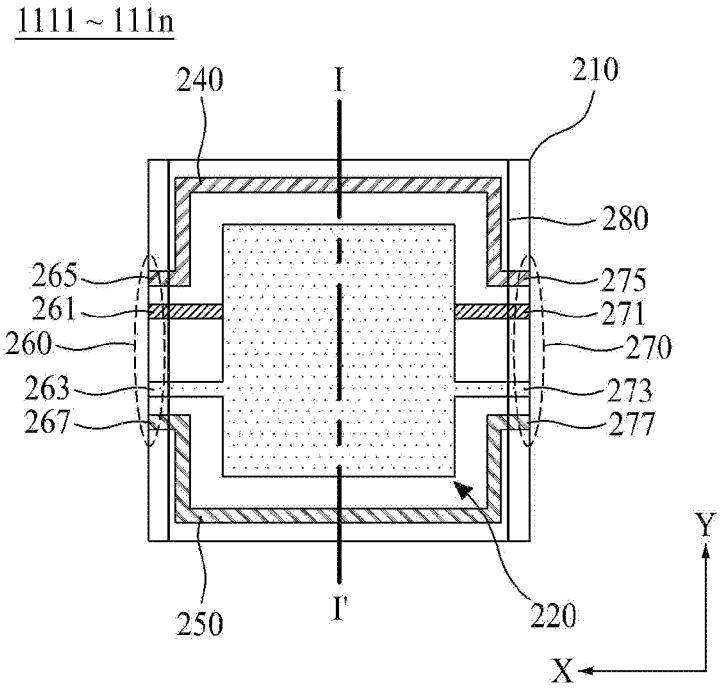
FIG. 3 is a diagram for describing each of a plurality of lighting panels according to an embodiment of the present invention illustrated in FIG. 2.
Figure 4:
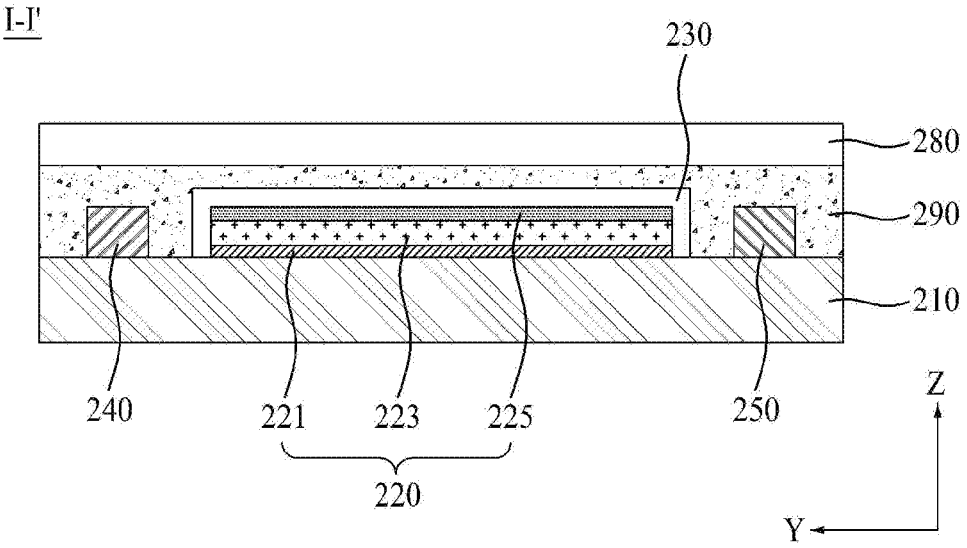
FIG. 4 is a cross-sectional view taken along line I-I' illustrated in FIG. 3.

FIG. 3 is a diagram for describing each of a plurality of lighting panels according to an embodiment of the present invention illustrated in FIG. 2, and FIG. 4 is a cross-sectional view taken along line I-I' illustrated in FIG. 3.

Referring to FIGS. 3 and 4, each of the plurality of lighting panels 1111 to 111*n* according to an embodiment of the present invention includes a first substrate 210, the emission part 220, an encapsulation layer 230, the first auxiliary wiring 240, the second auxiliary wiring 250, a first power terminal part 260, a second power terminal part 270, and a second substrate 280.

The first substrate 210 may be a transparent glass substrate or a transparent flexible substrate. Here, the transparent flexible substrate may be formed of one of polyethyleneterephthalate (PET), polycarbonate (PC), polyethersulfone (PES), polyethylenapthanate (PEN), and polynorborneen (PNB).

The emission part 220 may be formed on the first substrate 210 and may emit light according to the lighting power (e.g., an anode power and a cathode power) simultaneously supplied from each of the first and second power terminal parts 260 and 270 to irradiate the light for lighting. The emission part 220 may be formed between the first and second auxiliary wirings 240 and 250. The emission part 220 according to an embodiment may include a first electrode 221 formed on the first substrate 210, an organic layer 223 formed on the first electrode 221, and a second electrode 225 formed on the organic layer 223.

The first electrode 221 is deposited all over a portion other than an edge portion of the first substrate 210 and may be an anode electrode (or a first primary electrode or a first wiring). The lighting power (e.g., the anode power) is supplied to the first electrode 221 through the panel connection means. Here, if the lighting panels 1111 to 111*n* are a bottom and dual emission type, the first electrode 221 may be formed of a transparent conductive material, and if the lighting panels 1111 to 111*n* are a top emission type, the first electrode 221 may be formed of a reflective conductive material. Hereinafter, it is assumed that the first electrode 221 is formed of a transparent conductive material.

The organic layer 223 is formed on the first electrode 221 and emits light with a current flowing between the first and second electrodes 221 and 225. To this end, the organic layer 223 may include a hole injection layer, a hole transport layer, an organic emission layer, an electron transport layer, and an electron injection layer which are sequentially stacked on the first electrode 221. In the organic layer 223, an electron and a hole are recombined by the current flowing between the first and second electrodes 221 and 225 to generate an exciton having a high energy state in the organic emission layer, and the exciton is shifted from an excited state to a ground state to emit light based on an energy difference between two states, thereby emitting light for lighting.

The second electrode 225 is formed on the organic layer 223 and may be a cathode electrode (or a second primary electrode). If the lighting apparatus is a top and dual emission type, the second electrode 225 may be formed of a transparent conductive material, and if the lighting apparatus is a bottom emission type, the second electrode 225 may be formed of a reflective conductive material. Hereinafter, it is assumed that the second electrode 225 is formed of a reflective conductive material.

The encapsulation layer 230 is formed on the first substrate 210 to cover the emission part 220. The encapsulation layer 230 may have a multi-layer structure where an inorganic layer and an organic layer are alternately stacked. The encapsulation layer 230 prevents external oxygen and/or water from penetrating into the emission part 220, thereby preventing the emission part 220 from being deteriorated by the oxygen and/or the water.

The first auxiliary wiring 240 is for supplying power to the emission part 220 and is electrically connected to the first electrode 221 (or the first primary electrode). To this end, the first auxiliary wiring 240 is formed in one non-emission area of the first substrate 210 and is connected to the first and second power terminal parts 250 and 260, and may be a second wiring that diverts the lighting power without applying the lighting power to the emission part 220. In this case, the first auxiliary wiring 240 may be formed in a ⊓-shape in the one non-emission area of the first substrate 210 to surround one side of the emission part 220. The first auxiliary wiring 240 transmits the lighting power (e.g., the anode power), supplied from the first power terminal part 250, to the second power terminal part 260. The first auxiliary wiring 240 is a power transmission wiring and may be formed of a metal material which is low in sheet resistance and is high in electric conductivity.

The second auxiliary wiring 250 is for supplying power to the emission part 220 and is electrically connected to the second electrode 225 (or the second primary electrode). To this end, the second auxiliary wiring 250 is formed in the other non-emission area of the first substrate 210 and is connected to the first and second power terminal parts 250 and 260. In this case, the second auxiliary wiring 250 may be formed in a ⊔-shape in the other non-emission area of the first substrate 210 to surround the other side of the emission part 220 and has a symmetric structure about the first auxiliary wiring 240 with the emission part 220 therebetween. The second auxiliary wiring 250 transmits the lighting power (e.g., the cathode power), supplied from the second power terminal part 260, to the second power terminal part 260. The second auxiliary wiring 250 is a power transmission wiring and may be formed of a metal material which is the same as that of the first auxiliary wiring 210.

The first power terminal part 260 is formed in one edge portion of the first substrate 210, for example, a middle portion of a first vertical edge of the first substrate 210. The first power terminal part 260 may include a first anode power terminal 261 connected to one side of the first electrode 221 provided in the emission part 220, a first cathode power terminal 263 connected to one side of the second electrode 225 provided in the emission part 220, a first anode power transmission terminal 265 connected to one end of the first auxiliary wiring 240, and a first cathode power transmission terminal 267 connected to one end of the second auxiliary wiring 250. The first power terminal part 260 is electrically connected to a panel connection means adjacent to one side thereof.

The second power terminal part 270 is formed in the other edge portion of the first substrate 210, for example, a middle portion of a second vertical edge of the first substrate 210. The second power terminal part 270 may include a second anode power terminal 271 connected to the other side of the second electrode 225 provided in the emission part 220, a second cathode power terminal 273 connected to the other side of the second electrode 225 provided in the emission part 220, a second anode power transmission terminal 275 connected to the other end of the first auxiliary wiring 240, and a second cathode power transmission terminal 277 connected to the other end of the second auxiliary wiring 250. The second power terminal part 270 is electrically connected to a panel connection means adjacent to the other side thereof.

The second substrate 280 is formed to cover an upper portion of the first substrate 210 except the first and second power terminal parts 260 and 270 and acts as a protection substrate that protects the emission part 220. In this case, the second substrate 280 may be opposite-bonded to the first substrate 210 to cover the encapsulation layer 230 and the first and second auxiliary wirings 240 and 250 through a laminating process using a substrate bonding member 290, for example, an adhesive or an adhesive sheet.

In each of the plurality of lighting panels 1111 to 111*n* according to an embodiment of the present invention, the emission part 220 emits light with the lighting power which is supplied to the first and second electrodes 221 and 225 of the emission part 220 through the first and second power terminal parts 260 and 270, and the light emitted from the emission part 220 is output to the outside through the first electrode 221.

Figure 5:
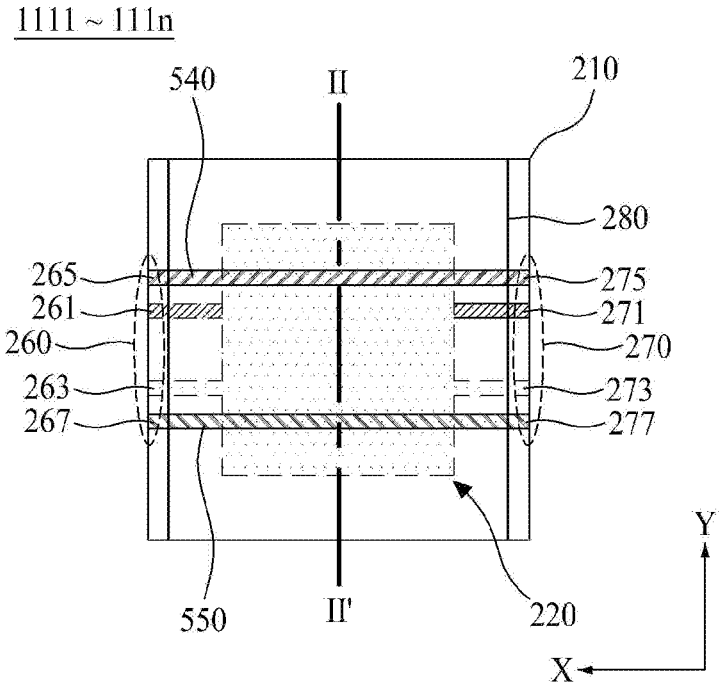
FIG. 5 is a diagram for describing each of a plurality of lighting panels according to another embodiment of the present invention illustrated in FIG. 2.
Figure 6:
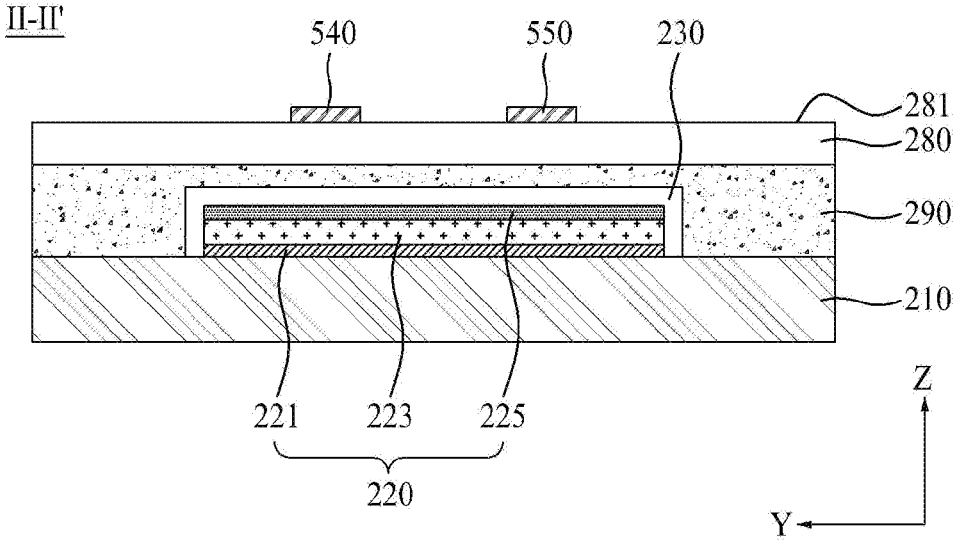
FIG. 6 is a cross-sectional view taken along line II-II' illustrated in FIG. 5.

FIG. 5 is a diagram for describing each of a plurality of lighting panels according to another embodiment of the present invention illustrated in FIG. 2, and FIG. 6 is a cross-sectional view taken along line II-II' illustrated in FIG. 5. The drawings illustrate a configuration implemented by modifying the first and second auxiliary wirings in each of a plurality of lighting panels according to an embodiment of the present invention illustrated in FIGS. 3 and 4. Hereinafter, therefore, only the first and second auxiliary wirings will be described, and repetitive descriptions of the other same elements are omitted.

As seen in FIGS. 5 and 6, in each of a plurality of lighting panels 1111 to 111*n* according to another embodiment of the present invention, each of first and second auxiliary wirings 540 and 550 is provided on an outer surface (or a rear surface) of the second substrate 280.

One end of the first auxiliary wiring 540 is connected to the first power terminal part 260, namely, the first anode power transmission terminal 265. The other end of the first auxiliary wiring 540 is connected to the second power terminal part 270, namely, the second anode power transmission terminal 275.

One end of the second auxiliary wiring 550 is connected to the first power terminal part 260, namely, the first cathode power transmission terminal 267. The other end of the second auxiliary wiring 550 is connected to the second power terminal part 270, namely, the second cathode power transmission terminal 277.

Each of the first and second auxiliary wirings 540 and 550 according to an embodiment may include a conductive pattern, deposited on a rear surface of the second substrate 280, and a conductive tape that respectively connects both ends of the conductive pattern to the first and second power terminal parts 260 and 270.

Each of the first and second auxiliary wirings 540 and 550 according to another embodiment may be a conductive tape which includes both ends respectively connected to the first and second power terminal parts 260 and 270 and is disposed on an outer surface 281 of the second substrate 280.

In addition, the first and second auxiliary wirings 540 and 550 may be insulated from each other by an insulating member (not shown). The insulating member may be an insulating tape.

If the lighting apparatus according to an embodiment has a single emission structure and irradiates light onto the first substrate 210, each of the first and second auxiliary wirings 540 and 550 according to an embodiment may be provided in a middle portion of the outer surface 281 of the second substrate 280 to overlap an emission area, or may be provided in an edge portion of the outer surface 281 of the second substrate 280 to overlap a non-emission area. Furthermore, if the lighting apparatus according to an embodiment has a dual emission structure, each of the first and second auxiliary wirings 540 and 550 according to another embodiment may be provided on the outer surface 281 of the second substrate 280 to overlap the non-emission area.

Figure 7:
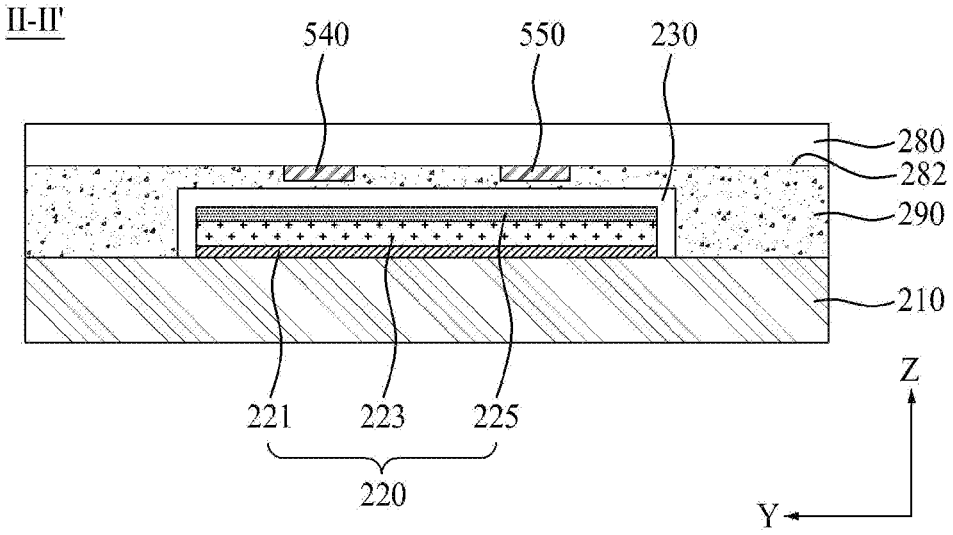
FIG. 7 is a cross-sectional view taken along line II-II' illustrated in FIG. 5 and is a cross-sectional view for describing first and second auxiliary wirings according to a modification embodiment.

In each of the plurality of lighting panels 1111 to 111*n* according to another embodiment of the present invention, each of the first and second auxiliary wirings 540 and 550 may not be provided on the outer surface of the second substrate 280, and as illustrated in FIG. 7, may be provided on an inner surface 282 of the second substrate 280 facing the first substrate 210. In this case, each of the first and second auxiliary wirings 540 and 550 is surrounded by the substrate bonding member 290, and thus, the insulating member is not needed.

Figure 8:
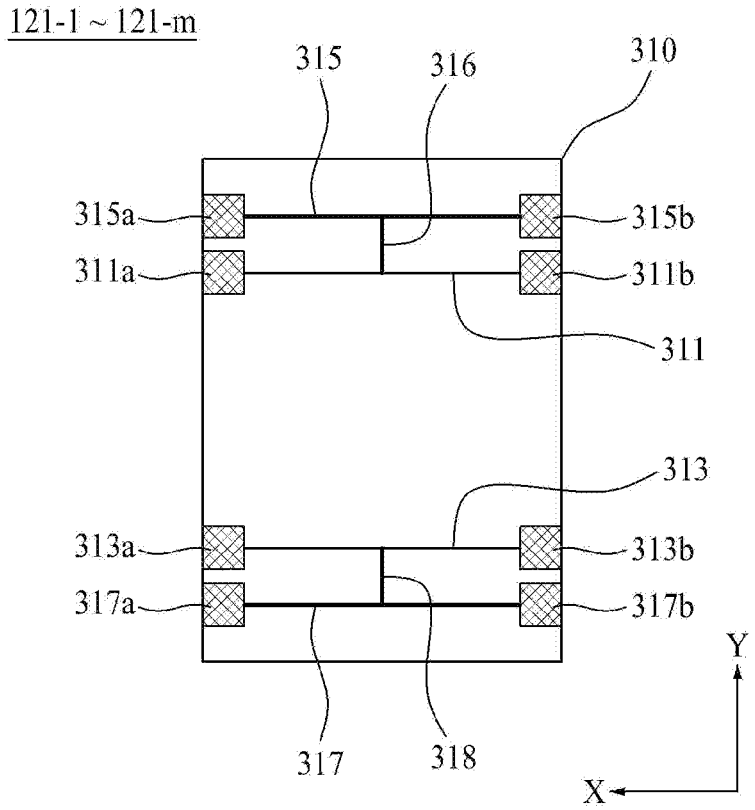
FIG. 8 is a diagram for describing each of a plurality of intermediate connection members according to an embodiment illustrated in FIG. 2.

FIG. 8 is a diagram for describing each of a plurality of intermediate connection members according to an embodiment illustrated in FIG. 2.

Referring to FIGS. 2 to 8, each of the plurality of middle connection members 121-1 to 121-*m* according to an embodiment electrically connects in parallel the first and second electrodes 221 and 225 between adjacent lighting panels. To this end, each of the plurality of middle connection members 121-1 to 121-*m* according to an embodiment includes a base substrate 310 and first to fourth parallel connection wirings 311, 313, 315 and 317.

The base substrate 310 is a flexible substrate and is connected between the second power terminal part 270 of a lighting panel (hereinafter referred to as one lighting panel) adjacent to one side thereof and the first power terminal part 260 of a lighting panel (hereinafter referred to as other lighting panel) adjacent to the other side thereof. Here, with respect to the lengthwise direction X of the lighting apparatus, the one lighting panel may be defined as a lighting panel adjacent to a left side with respect to the panel connection means 120, and the other lighting panel may be defined as a lighting panel adjacent to a right side with respect to the panel connection means 120.

The first parallel connection wiring 311 is formed on the base substrate 310 and is connected between first electrodes 221 of adjacent lighting panels. That is, the first parallel connection wiring 311 is connected to the second anode power terminal 271 provided in the second power terminal part 270 of the one lighting panel and is connected to the first anode power terminal 261 provided in the first power terminal part 260 of the other lighting panel. One end of the first parallel connection wiring 311 is connected to the second anode power terminal 271 through a first connection terminal 311*a*, and the other end of the first parallel connection wiring 311 is connected to the first anode power terminal 261 through a second connection terminal 311*b*.

The second parallel connection wiring 313 is formed on the base substrate 310, electrically disconnected from the first parallel connection wiring 311, and connected between second electrodes 225 of adjacent lighting panels. That is, the second parallel connection wiring 313 is connected to the second cathode power terminal 273 provided in the second power terminal part 270 of the one lighting panel and is connected to the first cathode power terminal 263 provided in the first power terminal part 260 of the other lighting panel. One end of the second parallel connection wiring 313 is connected to the second cathode power terminal 273 through a third connection terminal 313*a*, and the other end of the second parallel connection wiring 313 is connected to the first cathode power terminal 263 through a fourth connection terminal 313*b*.

The third parallel connection wiring 315 is formed on the base substrate 310, electrically disconnected from the first and second parallel connection wirings 311 and 313, connected between first auxiliary wirings 240 of adjacent lighting panels, and connected to the first parallel connection wiring 311. That is, the third parallel connection wiring 315 is connected to the second anode power transmission terminal 275 provided in the second power terminal part 270 of the one lighting panel, connected to the first anode power transmission terminal 265 provided in the first power terminal part 260 of the other lighting panel, and connected to the first parallel connection wiring 311 through a first bridge wiring 316 on the base substrate 310. One end of the third parallel connection wiring 315 is connected to the second anode power transmission terminal 275 through a fifth connection terminal 315*a*, and the other end of the third parallel connection wiring 315 is connected to the first anode power transmission terminal 265 through a sixth connection terminal 315*b*.

The fourth parallel connection wiring 317 is formed on the base substrate 310, electrically disconnected from first to third serial connection wirings 311, 313 and 315, connected between second auxiliary wirings 250 of adjacent lighting panels, and connected to the second parallel connection wiring 313. That is, the fourth parallel connection wiring 317 is connected to the second cathode power transmission terminal 277 provided in the second power terminal part 270 of the one lighting panel, connected to the first cathode power transmission terminal 267 provided in the first power terminal part 260 of the other lighting panel, and connected to the second parallel connection wiring 313 through a second bridge wiring 318 on the base substrate 310. One end of the fourth parallel connection wiring 317 is connected to the second cathode power transmission terminal 277 through a seventh connection terminal 317*a*, and the other end of the fourth parallel connection wiring 317 is connected to the first cathode power transmission terminal 267 through an eighth connection terminal 317*b*.

Each of the plurality of middle connection members 121-1 to 121-*m* according to an embodiment electrically connects in parallel the first and second electrodes 221 and 225 between adjacent lighting panels and supplies the lighting power to the first and second power terminal parts 260 and 270 of each of the lighting panels 1111 to 111*n*. Therefore, in the present invention, in a case where the lighting panels 1111 to 111*n* are driven in parallel, the lighting power is simultaneously supplied to one side and the other side of the emission part 220 provided in each of the lighting panels 1111 to 111*n*, thereby increasing the emission uniformity of each of the lighting panels 1111 to 111*n*. Also, the present invention transfers the lighting power to a next-end lighting panel through separate auxiliary wirings 240 and 250 provided in each of the lighting panels 1111 to 111*n*, and thus, can minimize the voltage drop of the lighting power supplied to each of the lighting panels 1111 to 111*n*.

Figure 9:
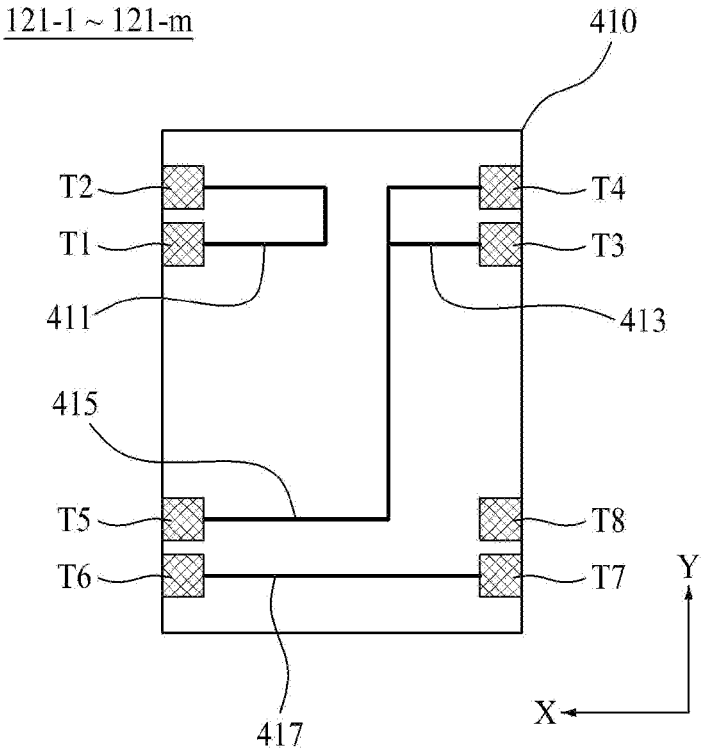
FIG. 9 is a diagram for describing each of a plurality of middle connection members according to another embodiment illustrated in FIG. 2.

FIG. 9 is a diagram for describing each of a plurality of middle connection members according to another embodiment illustrated in FIG. 2.

Referring to FIGS. 2 to 7 and 9, each of a plurality of middle connection members 121-1 to 121-*m* according to another embodiment electrically connects in parallel first and second electrodes 221 and 225 between adjacent lighting panels. To this end, each of the plurality of middle connection members 121-1 to 121-*m* according to another embodiment includes a base substrate 410, first and second connection wirings 411 and 413, and first and second serial connection wirings 415 and 417.

The base substrate 410 is a flexible substrate and is connected between the second power terminal part 270 of a lighting panel (hereinafter referred to as one lighting panel) adjacent to one side thereof and the first power terminal part 260 of a lighting panel (hereinafter referred to as other lighting panel) adjacent to the other side thereof. Here, with respect to the lengthwise direction X of the lighting apparatus, the one lighting panel may be defined as a lighting panel adjacent to a left side with respect to each panel connection means 120, and the other lighting panel may be defined as a lighting panel adjacent to a right side with respect to each panel connection means 120.

The first connection wiring 411 is formed on the base substrate 410 and connects the other side of the first auxiliary wiring 240 and the other side of the first electrode 221 provided in the one lighting panel. That is, the first connection wiring 411 is connected to the second anode power terminal 271 provided in the second power terminal part 270 of the one lighting panel and is connected to the second anode power transmission terminal 275 provided in the second power terminal part 270 of the one lighting panel. In this case, one end of the first connection wiring 411 is connected to the second anode power terminal 271 through a first connection terminal T1, and the other end of the first connection wiring 411 is connected to the second anode power transmission terminal 275 through a second connection terminal T2.

The second connection wiring 413 is formed on the base substrate 410 and is electrically disconnected from the first connection wiring 411, and connects one side of the first auxiliary wiring 240 to one side of the first electrode 221 provided in the other lighting panel. That is, the second connection wiring 413 is connected to the first anode power terminal 261 provided in the first power terminal part 260 of the other lighting panel and is connected to the first anode power transmission terminal 265 provided in the first power terminal part 260 of the other lighting panel. In this case, one end of the second connection wiring 413 is connected to the first anode power terminal 261 through a third connection terminal T3, and the other end of the second connection wiring 413 is connected to the first anode power transmission terminal 265 through a fourth connection terminal T4.

The first and second connection wirings 411 and 413 connect the first auxiliary wiring 240 and the first electrode 221 of each of the lighting panels 1111 to 111*n* in the form of a closed loop, thereby making the lighting power supplied to the first electrode 221 of each of the lighting panels 1111 to 111*n* uniform.

The first serial connection wiring 415 is formed on the base substrate 410 and is electrically disconnected from the first and second connection wirings 411 and 413, and connects one side of the second connection wiring 413 to the second electrode 225 provided in the one lighting panel. That is, the first serial connection wiring 415 is connected to the second cathode power terminal 273 provided in the second power terminal 270 of the one lighting panel and is connected to the second connection wiring 413 on the base substrate 410. One end of the first serial connection wiring 415 is connected to the second cathode power terminal 273 through a fifth connection terminal T5, and the other end of the first serial connection wiring 415 is connected to the second connection wiring 413. The first serial connection wiring 415 connects the second electrode 225 provided in the one lighting panel to the first electrode 221 provided in the other lighting panel, thereby electrically connecting the one lighting panel to the other lighting panel.

The second serial connection wiring 417 is formed on the base substrate 410, electrically disconnected from first to third serial connection wirings 411, 413 and 415, and electrically connected between second auxiliary wirings 250 of adjacent lighting panels. That is, the second serial connection wiring 417 is connected to the second cathode power transmission terminal 277 provided in the second power terminal part 270 of the one lighting panel and is connected to the first cathode power transmission terminal 267 provided in the first power terminal part 260 of the other lighting panel. One end of the second serial connection wiring 417 is connected to the second cathode power transmission terminal 277 through a sixth connection terminal T6, and the other end of the second serial connection wiring 417 is connected to the first cathode power transmission terminal 267 through a seventh connection terminal T7. The second serial connection wiring 417 serially connects the second auxiliary wirings 240 of the respective lighting panels 1111 to 111*n*. Therefore, each of the serially connected second auxiliary wirings 240 of the respective lighting panels 1111 to 111*n* acts as a power cable that is provided in each of the lighting panels 1111 to 111*n* and the panel connection means 120 and is not exposed to the outside of the lighting apparatus.

An eighth connection terminal T8, which is provided in the first power terminal part 260 and is connected to the first cathode power terminal 263, is additionally provided on the base substrate 410.

Each of the plurality of middle connection members 121-1 to 121-*m* according to another embodiment electrically and serially connects the first and second electrodes 221 and 225 between adjacent lighting panels and supplies the lighting power to the first and second power terminal parts 260 and 270 of each of the lighting panels 1111 to 111*n*. Therefore, in the present invention, the lighting panels 1111 to 111*n* may be electrically and serially connected to each other though the panel connection means 120 even without a power cable exposed to the outside of the lighting apparatus, thereby increasing expandability of a serial connection between the plurality of lighting panels 1111 to 111*n*.

Figure 10:
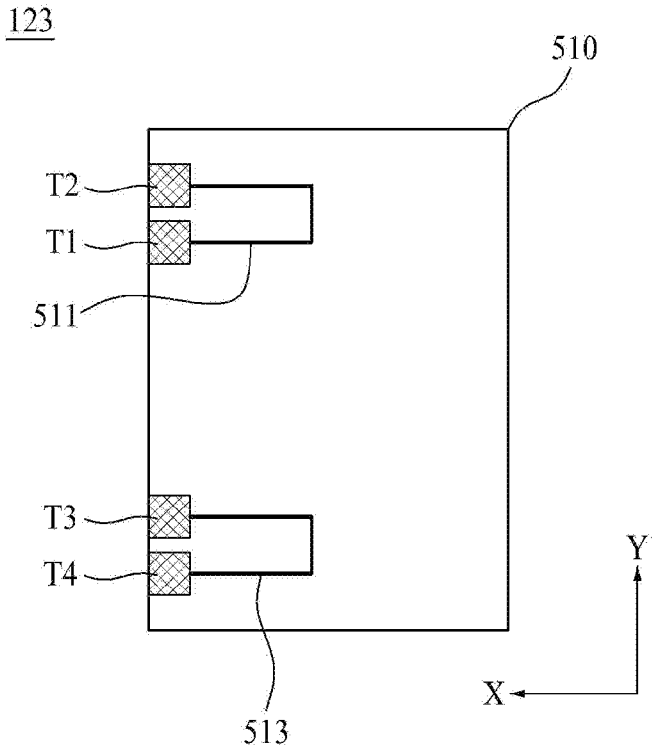
FIG. 10 is a diagram for describing each of a plurality of end connection members according to an embodiment illustrated in FIG. 2.

FIG. 10 is a diagram for describing each of a plurality of end connection members according to an embodiment illustrated in FIG. 2.

Referring to FIGS. 2 to 7 and 10, an end connection member 123 according to an embodiment of the present invention connects the first auxiliary wiring 240 and the first electrode provided in the last lighting panel 111*n* and connects the second auxiliary wiring 250 and the second electrode provided in the last lighting panel 111*n*. To this end, the end connection member 123 according to an embodiment includes a base substrate 510 and first and second end connection wirings 511 and 513.

The base substrate 510 is a flexible substrate and is connected to the second power terminal part 270 of the last lighting panel.

The first end connection wiring 511 is formed on the base substrate 510 and connects the other side of the first auxiliary wiring 240 and the other side of the first electrode 221 provided in the last lighting apparatus 111*n*. That is, the first end connection wiring 511 is connected to the second anode power terminal 271 and the second anode power transmission terminal 275 provided in the second power terminal part 270 of the last lighting panel 111*n*. In this case, one end of the first end connection wiring 511 is connected to the second anode power terminal 271 through a first connection terminal T1, and the other end of the first end connection wiring 511 is connected to the second anode power transmission terminal 275 through a second connection terminal T2.

The second end connection wiring 513 is formed on the base substrate 510 and connects the other side of the second auxiliary wiring 250 and the other side of the second electrode 225 provided in the last lighting apparatus 111*n*. That is, the second end connection wiring 513 is connected to the second cathode power terminal 273 and the second cathode power transmission terminal 277 provided in the second power terminal part 270 of the last lighting panel 111*n*. In this case, one end of the second end connection wiring 513 is connected to the second cathode power terminal 273 through a third connection terminal T3, and the other end of the second end connection wiring 513 is connected to the second cathode power transmission terminal 277 through a fourth connection terminal T4.

In addition, the end connection member 123 according to another embodiment of the present invention may have a structure which is the same as that of the middle connection members 121-1 to 121-*m* according to an embodiment of the present invention illustrated in FIG. 8.

The present invention as described above are not limited to the above-described embodiments and the accompanying drawings and those skilled in the art will clearly appreciate that various modifications, deformations, and substitutions are possible without departing from the scope and spirit of the invention. Therefore, it should be construed that the scope of the present invention is defined by the below-described claims instead of the detailed description, and the meanings and scope of the claims and all variations or modified forms inferred from their equivalent concepts are included in the scope of the present invention.

The invention claimed is:

1. A lighting apparatus comprising:

a plurality of lighting panels including an emission part having a light emitting device which emits light with a current flowing between a first electrode and a second electrode; and a panel connection means disposed between the plurality of lighting panels to electrically connect first and second electrodes between adjacent lighting panels, wherein each of the plurality of lighting panels comprises first and second auxiliary wirings electrically connected between adjacent panel connection means;

wherein the panel connection means further comprises an end connection member connected to a last lighting panel of the plurality of lighting panels, and the end connection member comprises:

a first end connection wiring connecting a first auxiliary wiring and a first electrode provided in the last lighting panel; and a second end connection wiring connecting a second auxiliary wiring and a second electrode provided in the last lighting panel.

2. The lighting apparatus of claim 1, wherein the panel connection means electrically and serially connects the first and second electrodes between the adjacent lighting panels.

3. The lighting apparatus of claim 2, wherein the panel connection means comprises a plurality of middle connection members disposed between the plurality of lighting panels, and each of the plurality of middle connection members comprises:

a first connection wiring connecting one side of the first auxiliary wiring to one side of a first electrode provided in one lighting panel adjacent to one side;

a second connection wiring connecting the other side of the first auxiliary wiring to the other side of a first electrode provided in other lighting panel adjacent to the other side;

a first serial connection wiring connecting the second connection wiring to a second electrode provided in the one lighting panel; and a second serial connection wiring connecting a second auxiliary wiring, provided in the one lighting panel, to a second auxiliary wiring provided in the other lighting panel.

4. The lighting apparatus of claim 1, wherein each of the plurality of lighting panels is simultaneously supplied with a lighting power through each of two adjacent panel connection means.

5. The lighting apparatus of claim 1, wherein the panel connection means electrically connects in parallel first and second electrodes between the adjacent lighting panels.

6. The lighting apparatus of claim 5, wherein the panel connection means comprises a plurality of middle connection members disposed between the plurality of lighting panels, and each of the plurality of middle connection members comprises:

a first parallel connection wiring connected between first electrodes of the adjacent lighting panels;

a second parallel connection wiring connected between second electrodes of the adjacent lighting panels;

a third parallel connection wiring connected between first auxiliary wirings of the adjacent lighting panels and connected to the first parallel connection wiring; and a fourth parallel connection wiring connected between second auxiliary wirings of the adjacent lighting panels and connected to the second parallel connection wiring.

7. The lighting apparatus of claim 1, wherein the light emitting device is a light emitting diode, and the emission part comprises a plurality of light emitting diodes connected in series or parallel between the first electrode and the second electrode.

8. The lighting apparatus of claim 1, wherein the light emitting device comprises an organic layer provided between the first and second electrodes.

9. The lighting apparatus of claim 8, wherein each of the plurality of lighting panels comprises:

a first substrate on which the emission part is provided, the emission part including the first electrode, the organic layer, and the second electrode;

a first power terminal part provided on one side of the first substrate and connected to one side of each of the first and second auxiliary wirings and the first and second electrodes;

a second power terminal part provided on the other side of the first substrate and connected to the other side of each of the first and second auxiliary wirings and the first and second electrodes;

an encapsulation layer formed on the first substrate to cover the emission part; and a second substrate covering the encapsulation layer.

10. The lighting apparatus of claim 9, wherein each of the first and second auxiliary wirings is provided on the first substrate, connected to the first and second power terminal parts, and covered by the second substrate, and the emission part is provided between the first and second auxiliary wirings.

11. The lighting apparatus of claim 9, wherein each of the first and second auxiliary wirings is provided on an inner surface or an outer surface of the second substrate and is connected to the first and second power terminal parts.

12. A lighting apparatus comprising: a plurality of lighting panels; and a panel connection means disposed between the plurality of lighting panels, wherein each of the plurality of lighting panels comprises:

an emission part including a light emitting device which emits light with a current flowing in a primary electrode;

a secondary electrode electrically connected to the primary electrode; and first and second auxiliary wirings electrically connected between adjacent panel connection means, wherein the panel connection means comprises an end connection member connected to a last lighting panel of the plurality of lighting panels, and the end connection member comprises:

a first end connection wiring connecting a first auxiliary wiring and a primary electrode provided in the last lighting panel; and a second end connection wiring connecting a second auxiliary wiring and a secondary electrode provided in the last lighting panel.

13. The lighting apparatus of claim 12, wherein the panel connection means electrically connects the two adjacent lighting panels of the plurality of lighting panels in series or parallel.

14. A lighting apparatus comprising:

a lighting panel including an emission part;

a first wiring provided in the lighting panel to supply power to the emission part; and a second wiring provided in the lighting panel to divert the power without supplying the power to the emission part;

an additional lighting panel adjacent to the lighting panel; and a panel connection means electrically connecting the lighting panel to the additional lighting panel, wherein the panel connection means comprises an end connection member connected to the additional lighting penal, and the end connection member comprises:

a first end connection wiring connecting a first auxiliary wiring and a first electrode provided in the additional lighting panel; and a second end connection wiring connecting a second auxiliary wiring and a second electrode provided in the additional lighting panel.

* * * * *